US010273919B2

(12) United States Patent
Asahi

(10) Patent No.: US 10,273,919 B2
(45) Date of Patent: Apr. 30, 2019

(54) END SEAL STRUCTURE OF FUEL RAIL FOR GASOLINE DIRECT-INJECTION ENGINE

(71) Applicant: USUI KOKUSAI SANGYO KAISHA LIMITED, Shimizu-cho, Sunto-gun, Shizuoka (JP)

(72) Inventor: Daisuke Asahi, Shimizu-cho (JP)

(73) Assignee: Usui Kokusai Sangyo Kaisha Limited (JP)

( * ) Notice: Subject to any disclaimer, the term of this patent is extended or adjusted under 35 U.S.C. 154(b) by 65 days.

(21) Appl. No.: 15/325,461

(22) PCT Filed: Aug. 6, 2015

(86) PCT No.: PCT/JP2015/072359
§ 371 (c)(1),
(2) Date: Jan. 11, 2017

(87) PCT Pub. No.: WO2016/021687
PCT Pub. Date: Feb. 11, 2016

(65) Prior Publication Data

US 2017/0159626 A1 Jun. 8, 2017

(30) Foreign Application Priority Data

Aug. 8, 2014 (JP) ..... 2014-162632

(51) Int. Cl.
*F02M 55/00* (2006.01)
*F02M 55/02* (2006.01)

(52) U.S. Cl.
CPC ..... *F02M 55/005* (2013.01); *F02M 55/025* (2013.01)

(58) Field of Classification Search
CPC ..... F02M 55/005; F02M 55/025
See application file for complete search history.

(56) References Cited

U.S. PATENT DOCUMENTS 2,625,955 A * 1/1953 Day ..... F16L 55/1152 138/89
6,470,859 B2 * 10/2002 Imura ..... F02M 55/04 123/447

(Continued)

FOREIGN PATENT DOCUMENTS

JP 2-199269 8/1990
JP 2005-120982 5/2005

(Continued)

OTHER PUBLICATIONS

International Search Report dated Nov. 2, 2015.

*Primary Examiner* — Joseph Dallo
(74) *Attorney, Agent, or Firm* — Gerald E. Hespos; Michael J. Porco; Matthew T. Hespos

(57) ABSTRACT

Provided is an end seal structure of a fuel rail for a gasoline direct injection engine, in which an end or both ends of a rail body composed of a pipe is/are closed by a thread fastening type of an end cap or end caps having a cap-nut shape, is characterized in that a metallic gasket is provided between an inner wall surface of the end cap having the cap-nut shape and an end section of the rail body, the end cap having the cap-nut shape is screwed and fixed to the rail body, and the gasket is tightened by an axial force created by tightening of the end cap having the cap-nut shape so that the end of the rail body is sealed.

1 Claim, 2 Drawing Sheets

(56) References Cited

U.S. PATENT DOCUMENTS

| | | | | |
|---|---|---|---|---|
| 2005/0284447 | A1* | 12/2005 | Usui | F02M 55/005 123/468 |
| 2009/0139595 | A1* | 6/2009 | Kato | F02M 55/005 138/109 |
| 2011/0023831 | A1* | 2/2011 | Klesse | F02M 55/025 123/447 |
| 2011/0108005 | A1* | 5/2011 | Nishizawa | F02M 55/025 123/469 |
| 2012/0210980 | A1* | 8/2012 | Bedekar | F02M 55/004 123/456 |
| 2012/0211209 | A1* | 8/2012 | Choi | F16L 19/086 165/178 |
| 2013/0056978 | A1* | 3/2013 | Swift | F16L 19/028 285/332 |

FOREIGN PATENT DOCUMENTS

| | | |
|---|---|---|
| JP | 2005-146976 | 6/2005 |
| JP | 2010-7651 | 1/2010 |
| JP | 2011-144768 | 7/2011 |
| JP | 5811376 | 11/2015 |

* cited by examiner

END SEAL STRUCTURE OF FUEL RAIL FOR GASOLINE DIRECT-INJECTION ENGINE

BACKGROUND

1. Field of the Invention

The present invention relates to an end seal structure of a fuel rail (delivery pipe) for supplying high-pressure fuel, which is supplied from fuel booster pumps of electronic fuel injection-type automobile engines or the like, through a fuel injector (an injection nozzle) directly injecting the fuel into an engine cylinder. More specifically, the present invention relates to an end seal structure of a fuel rail for a gasoline direct injection engine configured to directly supply the fuel from the rail to the injector with an injection pressure in the order of 20 MPa to 70 MPa.

2. Description of the Related Art

Some exemplary fuel rails can be mentioned as the conventional fuel rails for gasoline direct injection engines of this type. For example, an exemplary fuel rail includes a main pipe and several branch pipes and is constructed and arranged such that through-holes for receiving each branch pipe are formed in an outer wall of the main pipe, each through-hole having an annular wall that projects toward the outside and inside of the main pipe, respectively, and each branch pipe being fixed to the annular wall. Another exemplary fuel rail is constructed and arranged such that a branch pipe is connected to a body, which is an accumulating vessel, directly or via a branch joint fitting (nipple). Still another exemplary fuel rail is constructed and arranged such that a socket for connection of an injector is directly attached to a rail body constituted by a tubular member such as a pipe. Further, other exemplary fuel rails may be mentioned as the fuel rail constructed and arranged such that the socket for connection of the injector is directly attached to the rail body constituted by the tubular body such as the pipe. For example, an exemplary fuel rail includes an injector holder and a fastening bracket that are directly attached to a rail body constituted by a tubular body such as a pipe to which high-pressure fuel is supplied from a high-pressure fuel pump (see Japanese Patent Laid-Open No. 2010-7651). Also, a high-pressure fuel delivery pipe for a direct injection engine includes a cylindrical body pipe into which pressurized fuel from a high-pressure fuel pump is supplied, a plurality of sockets to which fuel injection valves coupled to the body pipe and operable to be opened and closed by a control unit are coupled, and a plurality of mounting stays integrally fastened to the body pipe so as to attach the body pipe to the engine (see Japanese Patent Laid-Open No. 2011-144768).

However, the above-mentioned conventional fuel rails for gasoline direct injection engines have the following problems.

Specifically, in the above-mentioned various conventional fuel rails for gasoline direct injection engines, a rail body constituted by a pipe such as a tubular body is constructed and arranged such that an end or both ends thereof are closed, and its end rail structure is, for example as illustrated in FIGS. 2 and 3 by enlarged views, generally configured such that end caps 112A and 112B are each joined by brazing to corresponding one of the ends of the openings of a cylindrical body pipe 111. Meanwhile, a problem that is identified and should be addressed is the strength of the end caps 112A and 112B closing the both ends of the body pipe 111 in the trends of higher pressures in gasoline direct injection systems. More specifically, the following and other problems are identified. In the case of the end seal structure configured by joining the end caps 112A and 112B by brazing to the body pipe 111 as illustrated in FIGS. 2 and 3, the end seal structure is configured such that, when an internal pressure is applied in the body pipe 111 which is the rail body, a force created in a radial direction of the rail body at the time of the body pipe 111 being deformed in the radial direction (swollen outward of the pipe) is received by the brazed portions 113A and 113B, respectively, so that these brazed portions 113A and 113B become the weakest portions in terms of their strength, which makes it difficult for gasoline direct injection systems to meet their higher-pressure requirements. Further, since the brazed portions 113A and 113B are in direct contact with the fuel (pressure medium), if there is any unevenness in the shape of these brazed portions, then it tends to become a factor of breakage of the brazed portions due to concentration of stress.

It is accordingly an aim of the present invention, which has been made in view of the problems found in the conventional fuel rails, to provide an end seal structure of a fuel rail for a gasoline direct injection engine, in particular in a rail body constituted by a tubular body such as a pipe constructed and arranged such that one end or both ends thereof are closed by an end cap or caps, having a simple structure and allowing the end cap portion to meet higher pressure requirements.

SUMMARY

An end seal structure of a fuel rail for a gasoline direct injection engine in accordance with the present invention employs a thread fastening mechanism in place of a conventional braze mounting mechanism, and has the construction and arrangement in which a thread fastening section receives a force created in the radial direction of the rail body under application of an internal pressure to the rail body and, the thread fastening section is not in contact with a fuel (pressure medium) by using a gasket as a sealing means thereof. The features of this end seal structure is characterized in that: in a fuel rail in which an end or both ends of a rail body composed of a pipe is/are closed by an end cap or end caps of the thread fastening type, the end cap having a cap-nut shape; a metallic gasket is provided between an inner wall surface of the end cap having the cap-nut shape and the end of the rail body, and the end cap having the cap-nut shape is screwed and fixed to the rail body; and the gasket is tightened by the axial force created by tightening of the end cap having the cap-nut shape to seal the end of an opening of the rail body.

With regard to materials of the rail body and the end cap having the cap-nut shape, a preferable aspect of the present invention is that stainless steel or any material obtained by subjecting low-carbon steel to surface treatment using nickel (Ni) or a Ni-based alloy is used in view of corrosion resistance and pressure resistance. Further, with regard to the metallic gasket, a preferable aspect of the present invention is that the gasket is made from copper or brass in view of sealing properties and corrosion resistance.

The end seal structure of the fuel rail for the gasoline direct injection engine in accordance with the present invention employs the thread fastening mechanism using the end cap having the cap-nut shape as a mounting mechanism for mounting the end cap to the rail body, and employs the gasket seal mechanism as a seal mechanism, so that the metallic gasket is tightened by the axial force created by tightening of the end cap having the cap-nut shape which is screwed and fixed to the rail body, and thereby the end of the rail body is sealed. With the configuration, the end seal structure of the invention has the following advantageous effects: since the force created at the time of the rail body being deformed in the radial direction (swollen outward of the pipe) under application of an internal pressure to the rail body is received by the thread fastening section and thus the thread fastening section acts as a compressive stress against the deformation of the rail body at the time of application of the internal pressure, the end seal structure becomes advantageous in terms of resistance to fatigue failure and allows to sufficiently meet the higher pressure requirements of a system; since the thread fastening section is configured to be not in contact with the fuel (pressure medium), even when any unevenness exists in the shape of the thread fastening section, it does not act as a cause of breakage due to the concentration of stress; the gasket seal mechanism makes it possible to ensure the stability and reliability of the seal at the end of the rail body; when other components (injector socket, bracket, etc.) are brazed to the rail body, substitution of the atmosphere gas in the rail body proceeds smoothly in a brazing furnace by virtue of the both end sections of the rail body placed in an opened state, making it possible to achieve good brazing quality; when the rail body and the end cap having the cap-nut shape are made from stainless steel or any material obtained by subjecting low-carbon steel to surface treatment using nickel (Ni) or a Ni-based alloy, the corrosion resistance and the pressure resistance are enhanced; and when the gasket is made from copper or brass, the sealing properties and the corrosion resistance are enhanced.

DETAILED DESCRIPTION

A main pipe rail in accordance with the present invention is a main body of a fuel rail for gasoline direct injection engines, in which a fuel inlet pipe (not shown) is connected to one end or a wall surface of the main pipe rail, the fuel inlet pipe is connected by a piping (not shown) to a fuel tank (not shown), fuel of the fuel tank is transferred to the fuel inlet pipe through the piping and a fuel pump, made to flow from the fuel inlet pipe to the main pipe rail, and then injected from an injector (not shown) into a cylinder (not shown). The main pipe rail 1 includes a plurality of sockets (not shown) or the like in its circumferential wall portion, the socket being adapted to allow the injector to be connected thereto. By way of example, a four-cylinder engine and an in-line six-cylinder engine will be equipped with four sockets and six sockets, respectively, which are provided at desired intervals.

Figure 1:
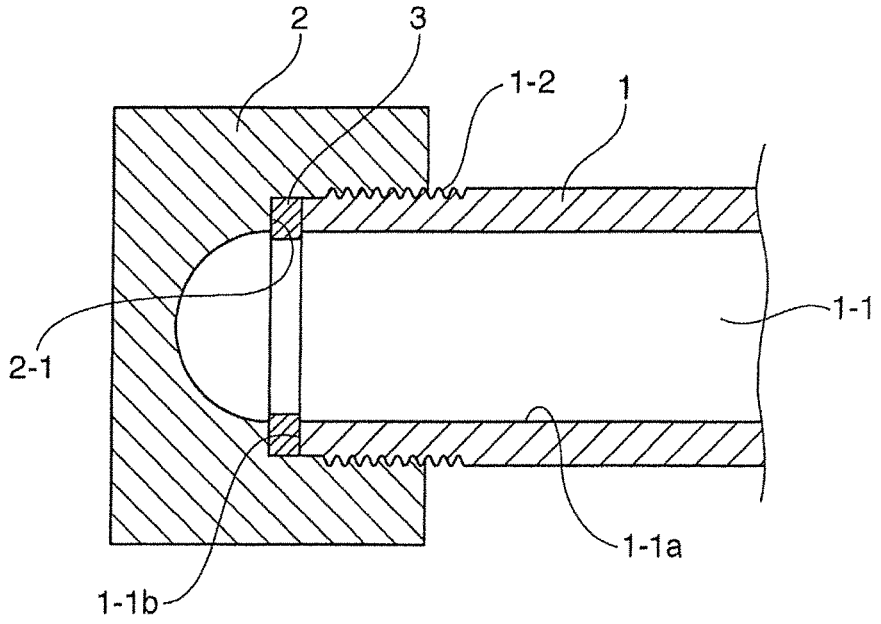
FIG. 1 is a cross-sectional view illustrating an end seal structure of a fuel rail for a gasoline direct injection engine in accordance with an embodiment of the present invention.
Figure 2:
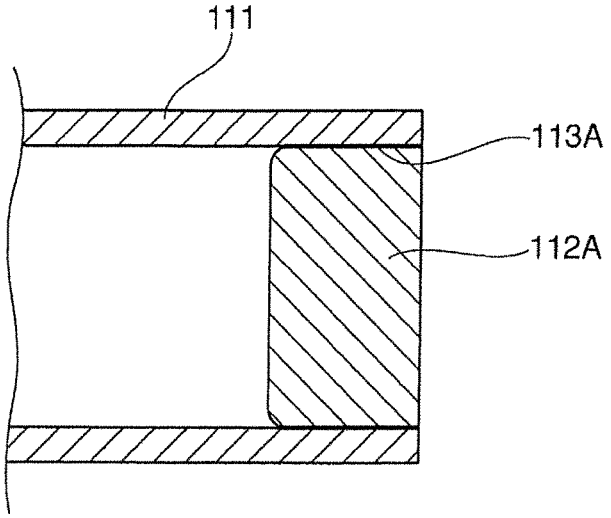
FIG. 2 is a cross-sectional view illustrating an example of a conventional end seal structure of a fuel rail for a gasoline direct injection engine.
Figure 3:
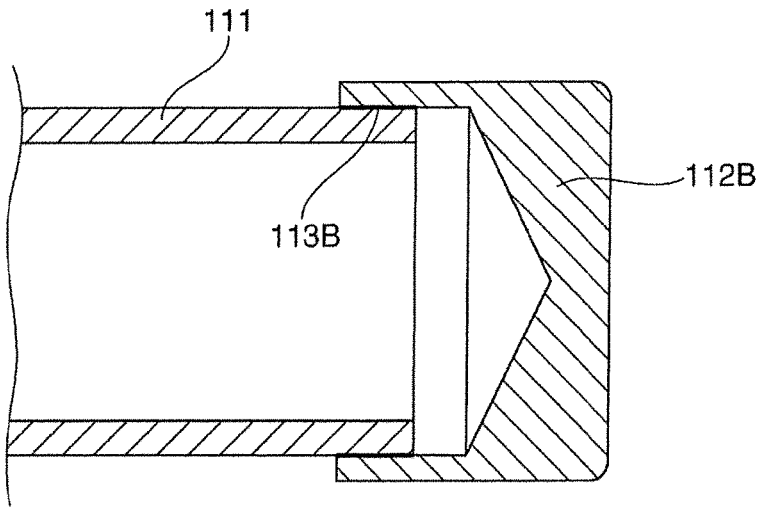
FIG. 3 is a cross-sectional view illustrating another example of a conventional end seal structure of a fuel rail for a gasoline direct injection engine.

In FIG. 1, a reference sign 1 denotes a rail body 1, a reference sign 2 denotes an end cap 2 with a cap-nut shape, and a reference sign 3 denotes a gasket 3. More specifically, in an end seal structure of a fuel rail for a gasoline direct injection engine in accordance with an embodiment illustrated in FIG. 1, an external thread 1-2 is formed on an outer circumferential surface of an end section of the pipe of the rail body 1 that has a cylindrical inner circumferential wall surface 1-1*a* defining a flow passage 1-1 therein except for the opening end face 1-1*b* on the side of the end cap. Meanwhile, the end cap 2 having the cap-nut shape and fastened to the outer circumference of the end section of the pipe of the rail body 1 includes a pressure receiving surface 2-1 of the gasket 3 on an inner wall surface which is a surface facing the opening end face 1-1*b* of the rail body 1, the pressure receiving surface 2-1 defining a seat surface. The end cap 2 is configured to be screwed and attached to the external thread 1-2 formed at the end section of the pipe of the rail body 1. In this regard, it is preferable that the rail body 1 and the end cap 2 having the cap-nut shape are made from stainless steel or any material obtained by subjecting low-carbon steel to surface treatment using nickel (Ni) or a Ni-based alloy, taking into account corrosion resistance and pressure resistance. Also, it is preferable that the gasket 3 is made from copper or brass with its sealing properties and corrosion resistance taken into account.

When the end of the rail body 1 is sealed, the gasket 3 is fitted into the end cap 2 having the cap-nut shape and brought into abutment on the pressure receiving surface 2-1 formed on an inner surface of the cap, and, in this state, the end cap 2 having the cap-nut shape is screwed and tightened to the external thread 1-2 formed in the end section of the pipe of rail body 1. At this point, the gasket 3 is pressed and brought into pressure contact with the pressure receiving surface 2-1 in the end cap 2 having the cap-nut shape by the axial force created by the tightening of the end cap 2 having the cap-nut shape and thereby the end of the rail body 1 is sealed.

According to the end seal structure of the fuel rail for the gasoline direct injection engine shown in FIG. 1, as described above, when the end cap 2 having the cap-nut shape threadedly attached to the end section of the pipe of the rail body 1 is tightened and the gasket 3 is then brought into pressure contact with the pressure receiving surface 2-1 provided on the end cap by the axial force created by the tightening of the end cap 2 having the cap-nut shape, the end of the opening of the rail body 1 is thus sealed, and as a result, the thread fastening section of the rail body 1 and the end cap 2 having the cap-nut shape, and the flow passage 1-1 of the rail body 1 are completely closed. Accordingly, with this end seal structure of the fuel rail for the gasoline direct injection engine, the thread fastening section of the end cap 2 having the cap-nut shape acts as a compressive stress against deformation in the radial direction of the rail body 1 (swelling toward the outside of the pipe) which is created when an internal pressure acts upon the flow passage 1-1 of the rail body 1. As a result, the thread fastening section exhibits excellent characteristics in terms of resistance to fatigue failure and has the capability of accommodating itself to a higher internal pressure applied to the flow passage 1-1 of the rail body 1. Also, the thread fastening section of the end cap 2 having the cap-nut shape is constructed and arranged such that it does not contact the fuel (pressure medium) in the rail body 1. Accordingly, even if the shape of the thread fastening section has any unevenness, it never acts as a factor that leads to breakage due to concentration of stress. Moreover, the stability and reliability of the seal at the end of the rail body 1 are ensured thanks to the metal seal mechanism that the gasket 3 is brought into pressure contact with the pressure receiving surface 2-1 provided on the end cap by the axial force created by tightening of the end cap 2 having the cap-nut shape and thereby the end of the rail body 1 is sealed.

Also in the present invention, when the rail body 1 and the end cap 2 having the cap-nut shape are made from stainless steel or any material obtained by subjecting low-carbon steel to surface treatment using nickel (Ni) or a Ni-based alloy, then the corrosion resistance and the pressure resistance are enhanced, which leads to longer service life. In addition, when the gasket is made from copper or brass, its sealing properties and the corrosion resistance are enhanced, which in turn ensures improved sealing stability and reliability.

REFERENCE SIGNS LIST

1 Rail body
1-1 Flow passage
1-1*a* Inner circumferential wall surface
1-1*b* Opening end face
1-2 External thread
2 End cap having a cap-nut shape
2-1 Pressure receiving surface
3 Gasket

The invention claimed is:

1. An end seal structure of a fuel rail for a gasoline direct injection engine, comprising:

a rail body composed of a pipe having at least one end with an opening;

at least one end cap at the at least one end of the rail body, the at least one end cap being of a thread fastening type; and a metallic gasket provided between an inner wall surface of the end cap having the cap-nut shape and the at least one end of the rail body, and wherein:

the rail body and the at least one end cap having the cap-nut shape are made from stainless steel or a material obtained by subjecting low-carbon steel to surface treatment using nickel or a nickel-based alloy;

the gasket is made from copper or brass;

the at least one end cap having the cap-nut shape is screwed and fixed to the at least one end of the rail body; and the gasket is tightened by an axial force created by tightening of the at least one end cap having the cap-nut shape so as to seal the opening at the at least one end of the rail body.

* * * * *